US006047446A

United States Patent [19]

Leder et al.

[11] Patent Number: 6,047,446

[45] Date of Patent: Apr. 11, 2000

[54] CARDING MACHINE INCLUDING A DEVICE FOR ADJUSTING THE DISTANCE BETWEEN FLAT BARS AND THE CARDING CYLINDER

[75] Inventors: Armin Leder; Robert Pischel, both of Mönchengladbach, Germany

[73] Assignee: Trützschler GmbH & Co. KG, Mönchengladbach, Germany

[21] Appl. No.: 09/325,773

[22] Filed: Jun. 4, 1999

[30] Foreign Application Priority Data

Jun. 5, 1998 [DE] Germany ..... 198 25 317

[51] Int. Cl.[7] ..... D01G 15/30

[52] U.S. Cl. ..... 19/102; 19/103; 19/111

[58] Field of Search ..... 19/98, 99, 102, 19/103, 104, 110, 111, 112, 113, 114

[56] References Cited

U.S. PATENT DOCUMENTS

| | | | |
|---|---|---|---|
| 5,398,381 | 3/1995 | Schlichter et al. | 19/102 |
| 5,542,154 | 8/1996 | Demuth et al. | 19/114 |
| 5,625,924 | 5/1997 | Sauter et al. | 19/102 |
| 5,845,368 | 12/1998 | Varga | 19/103 |
| 5,894,636 | 4/1999 | Sauter et al. | 19/102 |
| 5,918,349 | 7/1999 | Leifeld et al. | 19/103 |

FOREIGN PATENT DOCUMENTS

| | | |
|---|---|---|
| 745 707 | 3/1944 | Germany . |
| 26 04 465 | 8/1976 | Germany . |
| 94 05 880 | 7/1994 | Germany . |
| 39 07 396 | 7/1998 | Germany . |

*Primary Examiner*—Michael A. Neas
*Assistant Examiner*—Gary L. Welch
*Attorney, Agent, or Firm*—Venable; Gabor J. Kelemen

[57] ABSTRACT

A carding machine includes a main carding cylinder having a cylinder axis and carrying a cylinder clothing on a circumferential surface thereof and a traveling flats assembly cooperating with the main carding cylinder along a circumferential length portion thereof. The traveling flats assembly includes a plurality of flat bars each having a flat bar clothing cooperating with the cylinder clothing; and a drive member for moving the flat bars in unison in an endless path; a rigid support member fixedly held on a machine frame laterally of the main carding cylinder and having a convex supporting surface; and a slide guide at least indirectly held on the supporting surface of the support member. The slide guide has a convex upper surface supporting the flat bars for sliding motion thereon and an opposite, lower surface. The radial distance between clothing points of the flat bar clothings and the carding cylinder clothing are determined and are changeable by the shape and/or the position of the slide guide.

20 Claims, 3 Drawing Sheets

CARDING MACHINE INCLUDING A DEVICE FOR ADJUSTING THE DISTANCE BETWEEN FLAT BARS AND THE CARDING CYLINDER

CROSS REFERENCE TO RELATED APPLICATIONS

This application claims the priority of German Application No. 198 25 317.6 filed Jun. 5, 1998, which is incorporated herein by reference.

United States application Ser. No. 08/988,422 filed Dec. 10, 1997 discloses related subject matter.

BACKGROUND OF THE INVENTION

The invention relates to a distance adjusting device in a carding machine which has a traveling flats assembly composed of a plurality of clothed flat bars, an endless drive element, such as a flexible belt and flexible slide guides on which opposite ends on the flat bars glide. The slide guides are of outwardly convex configuration and are supported on a likewise outwardly convex supporting element forming part of the machine frame.

In practice the flat bars glide on arcuate, strip-like bars, termed as flexible bends which are arranged approximately concentrically to the carding cylinder and are secured to side plates of the machine frame in such a manner that they may be adjusted in their position by means of screw-like setting spindles. Since wear or regrinding of the clothing causes a reduction in the radius of the circle circumscribable about the points of the cylinder clothing, the flexible bends, as they approach the carding cylinder, have to be able to yield to adapt their curvature to the reduced cylinder radius. The same applies to the compensation of manufacturing tolerances. For this purpose, the flexible bends are in most cases cast from a special alloy which has a substantial elasticity and may yield to assume the required shape. An adjustment will effect a shift of approximately between 0.2 and 4 mm of the glide surface. It is a disadvantage of such a conventional arrangement that undesired bends may occur during the various radial adjustments. Further, the geometry of the flexible bend depends from the number of the setting spindles, that is, the accuracy and uniformity of the distance between the flat bar clothing and the cylinder clothing is not uniform as viewed over the entire arc. It is a further drawback that manufacturing and assembly costs are very high; a manufacture and finishing of individual components are required. The flexible bend tends to be twisted because of its own insubstantial stiffness. The complex setting process by means of the setting spindles to obtain a uniform carding gap in the circumferential direction at the assembly start or for a new setting during operation is also a disadvantage.

For improving the sliding properties of the flat bars to thus eliminate the need of a lubrication of the cast surface by a graphite block, it is known to provide a strip-like plastic slide guide in a longitudinal groove provided in the flexible bend. Such plastic slide guide on which the flat bars glide, projects slightly beyond the flexible bend and is concentric therewith. The flexible bend constitutes the support member for the slide guide.

SUMMARY OF THE INVENTION

It is an object of the invention to provide an improved device of the above-outlined type from which the discussed disadvantages are eliminated, which has a particularly simple structure that is easy to assemble and which permits a more accurate and more uniform adjustment of the radial distance between the clothings of the flat bars and the carding cylinder.

This object and others to become apparent as the specification progresses, are accomplished by the invention, according to which, briefly stated, the carding machine includes a main carding cylinder having a cylinder axis and carrying a cylinder clothing on a circumferential surface thereof and a traveling flats assembly cooperating with the main carding cylinder along a circumferential length portion thereof. The traveling flats assembly includes a plurality of flat bars each having a flat bar clothing cooperating with the cylinder clothing; a drive member for moving the flat bars in unison in an endless path; a rigid support member fixedly held on a machine frame laterally of the main carding cylinder and having a convex supporting surface; and a slide guide at least indirectly held on the supporting surface of the support member. The slide guide has a convex upper surface supporting the flat bars for sliding motion thereon and an opposite, lower surface. The radial distance between clothing points of the flat bar clothings and the carding cylinder clothing are determined and are changeable by the shape and/or the position of the slide guide.

The known flexible bend is entirely dispensed with by virtue of the fact that the distance between the clothing points of the flat bars and the carding cylinder may be adjusted solely by means of a shape and/or position of the flexible slide guide mounted on a rigid supporting surface. A change in the radius of curvature is effected solely by the slide guide wherein the flexibility cooperates in a combinative manner with the shape and/or position of the slide guide. The slide guide may be a bar, a ribbon or the like which in the simplest case is arranged in a groove of the rigid side plate of the machine frame or is mounted on a supporting surface oriented parallel to the side plate. In this manner a very substantial simplification is achieved as far as structure and assembly are concerned. Further, as opposed to known devices, a spot-wise setting is eliminated so that an accurate and uniform adjustment of the distance between the cylinder and flat bar clothings may be achieved.

The invention has the following additional advantageous features:

- The distance between flat bars and carding cylinder is determined by the radial dimension of the slide guide.
- The upper surface (slide surface) and the opposite, lower surface (supporting surface) of the slide guide are arcuate and extend parallel to one another.
- The upper surface (slide surface) and the opposite, lower surface (supporting surface) of the slide guide are arcuate and converge toward one another, whereby the slide guide has a wedge-shaped configuration.
- The slide guide is displaceable in the circumferential direction relative to its support member.
- The slide guide is replaceable.
- The supporting surface is constituted by a convex surface of the side plate.
- The supporting surface is arranged parallel to the convex surface of the side plate.
- The supporting surface and the side plate form a single-piece component.
- The supporting surface is cast on the side plate.
- The supporting surface has a groove in which one part of the slide guide is received.
- The slide guide is a wear-resistant, low-friction flexible plastic.

The oblique bottom face of the slide guide is cooperating with a correspondingly oblique supporting surface.

Upon adjustment of the additional wedge-shaped slide guide a displacement of approximately 0.01–0.3 mm of its slide surface occurs.

DESCRIPTION OF THE PREFERRED EMBODIMENTS

Figure 1:
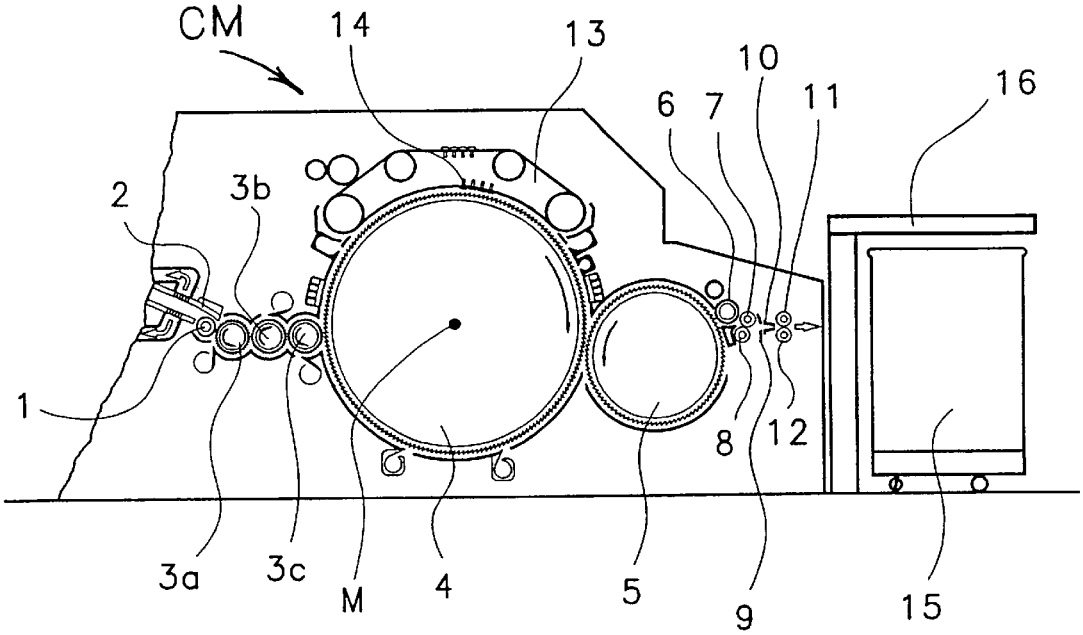
FIG. 1 is a schematic side elevational view of a carding machine adapted to incorporate the invention.

FIG. 1 illustrates a carding machine CM which may be, for example, an EXACTACARD DK 803 model, manufactured by Trützschler GmbH & Co. KG, Monchengladbach, Germany. The carding machine CM has a feed roll 1 cooperating with a feed table 2, licker-ins 3*a*, 3*b*, 3*c*, a main carding cylinder 4 having a rotary axis M, a doffer 5, a stripping roll 6, crushing rolls 7, 8, a web guiding element 9, a web trumpet 10, calender rolls 11, 12, a traveling flats assembly 13 having flat bars 14, a coiler can 15 and a sliver coiler 16.

Figure 2A:
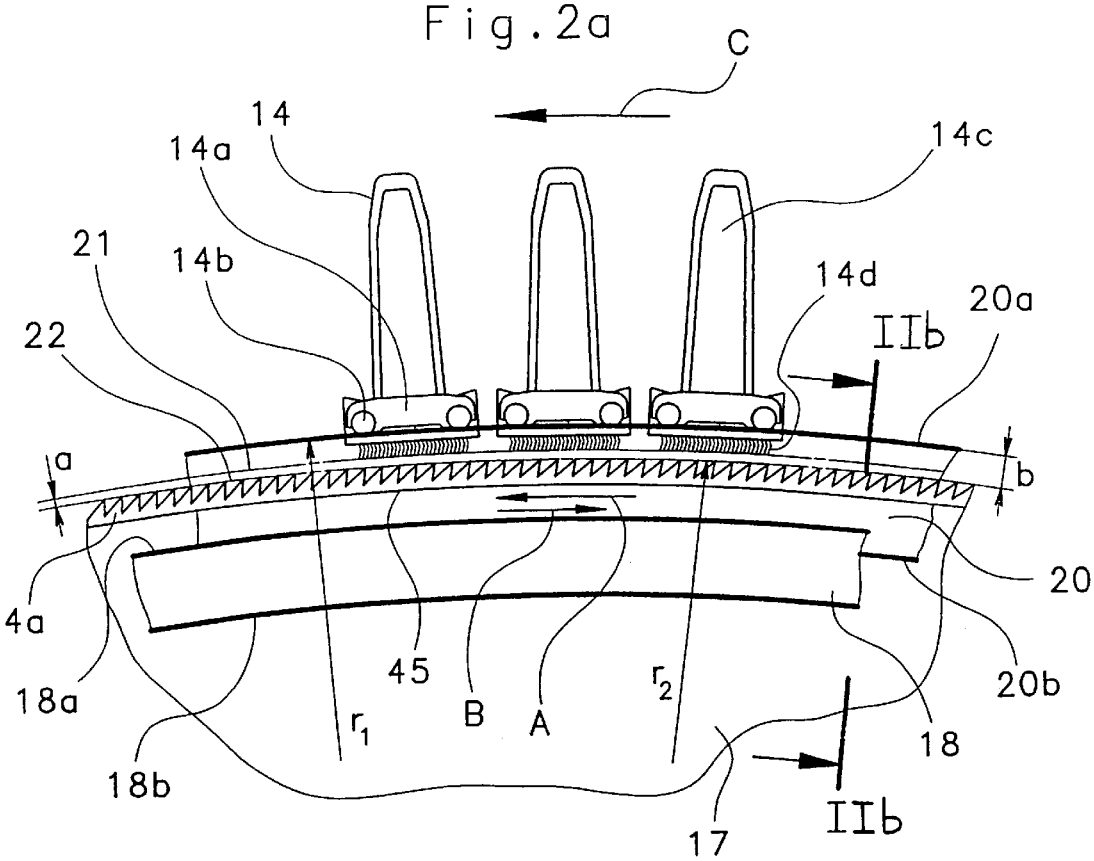
FIG. 2*a* is a schematic side elevational view showing one part of a traveling flats assembly incorporating the invention.
Figure 2B:
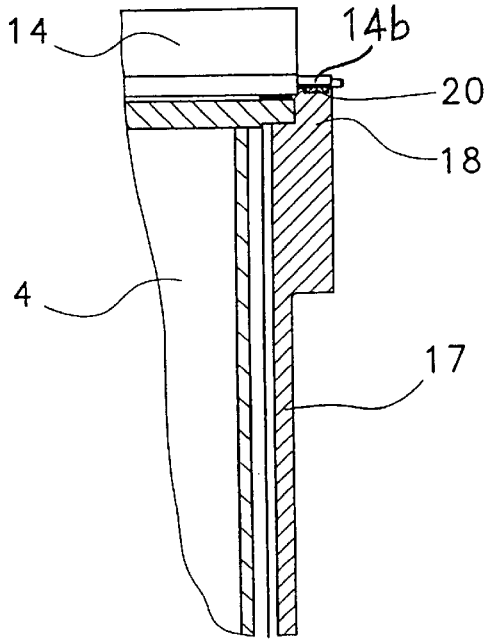
FIG. 2*b* is a sectional view taken along line IIb—IIb of FIG. 2*a*.

Turning to FIGS. 2*a* and 2*b*, to axially opposite sides of a non-illustrated machine frame, approximately semicircular rigid side plates 17 are secured (only one is visible). A rigid, arcuate support bar 18 is cast onto each side plate 17 in a concentric relationship therewith. The support bar 18 has a convex outer supporting surface 18*a* and an underside 18*b*. A slide guide 20 which is made of a low-friction synthetic material is disposed above the support bar 18 and has a convex outer face 20*a* and a concave inner face 20*b*. Also referring to FIG. 2*c*, the concave inner face 20*b* lies on the convex outer face 18*a* in a longitudinal groove 18*c* provided in the face 18*a* of the support bar 18. The slide guide 20 may be shifted relative to the support bar 18 in the direction of the arrows A, B. The displacement of the slide guide 20 may be effected by a non-illustrated shifting device including a driving mechanism such as a motor, a gearing or the like.

The flat bars 14 have at opposite ends (as viewed parallel to the cylinder axis M) a flat bar head 14*a* from which axially extend two steel pins 14*b* which slide on the convex outer face 20*a* of the slide guides 20 in the direction of the arrow C. Each flat bar 14 has a carrier body 14*c*, to the underface of which a flat bar clothing 14*d* is secured. The clothing points of the flat bar clothings 14*d* lie on an imaginary circle 21. The main carding cylinder 4 has, on its circumferential surface, a cylinder clothing 4*a* which may be, for example, a sawtooth clothing. The points of the cylinder clothing 4*a* lie on an imaginary circle 22. The distance between the circles 21 and 22 is designated at a and has a magnitude of, for example, 0.20 mm. The distance between the convex outer face 20*a* and the circle 22 is designated at b. The radius of the convex outer face 20*a* is designated at $r_1$ and the radius of the circle 22 is designated at $r_2$. The radii $r_1$ and $r_2$ intersect one another in the axis M of the main carding cylinder 4.

Figure 2C:
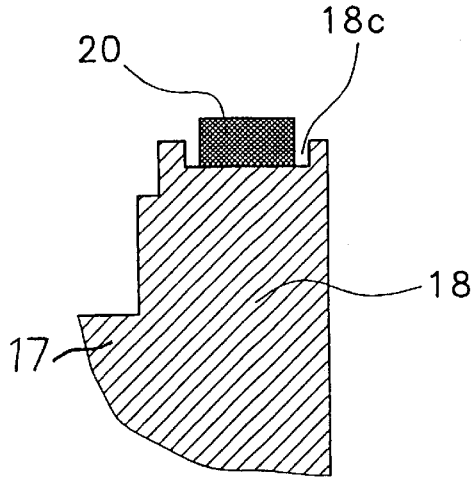
FIG. 2*c* is an enlarged detail of the structure shown in FIG. 2*b*.
Figure 3:
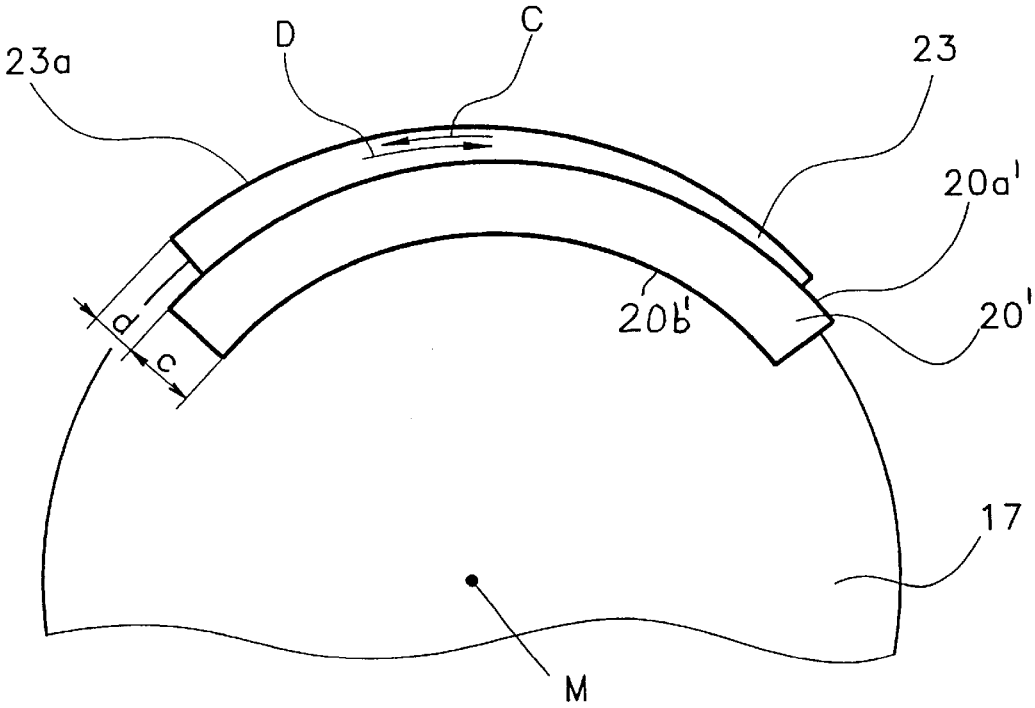
FIG. 3 is a schematic side elevational view showing the principle of operation of a distance adjusting device according to a preferred embodiment of the invention.

Referring to FIG. 3, a slide backup 20' is stationarily received in a groove 18*c* of the support bar 18, similarly to the arrangement shown in FIG. 2*c*. The slide backup 20' has a relatively large radial dimension (radial thickness). The center of curvature of the arcuate base of the groove 18*c* is eccentric relative to the axis M of the main carding cylinder 4. The arcuate slide backup 20' has parallel upper and lower faces 20*a*' and 20*b*'. The upper face 20*a*' supports a wedge-shaped slide guide 23 which has an upper convex surface 23*a* and which may be shifted relative to the slide backup 20' in the direction of the arrows C and D. The slide guide 23 has a relatively small radial dimension d and serves for a fine adjustment. Accordingly, it has a relatively small slope of 1:250, that is, a 50 mm shift in the direction C or D results in an approximately 0.2 mm radial change. The radial dimension of the slide backup 20' serves for compensating for manufacturing tolerances and unlike heights of clothings. The components 20' and 23 are replaceable.

Figure 4:
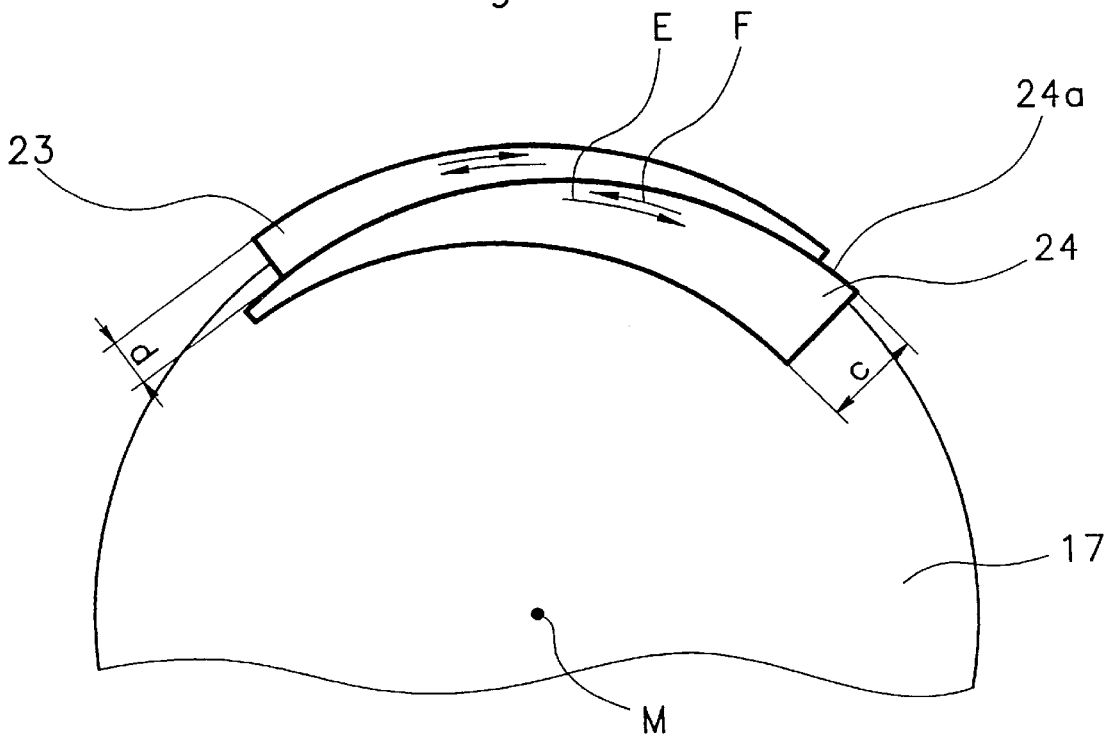
FIG. 4 is a schematic side elevational view of a further preferred embodiment of the distance adjusting device.

FIG. 4 shows a slide backup 24 which is a coarse wedgeshaped strip having a relatively large slope of 1:15, that is, a 50 mm shift in the direction E or F in the circumferential groove 18*c* results in an approximately 3.3 mm radial change. The slide backup 24 serves to compensate for manufacturing tolerances and unlike clothing heights. A wedge-shaped slide guide 23 is arranged on the outer, convex surface 24*a* of the slide backup 24. The slopes of the components 23 and 24 are oriented opposite to one another.

Figure 5:
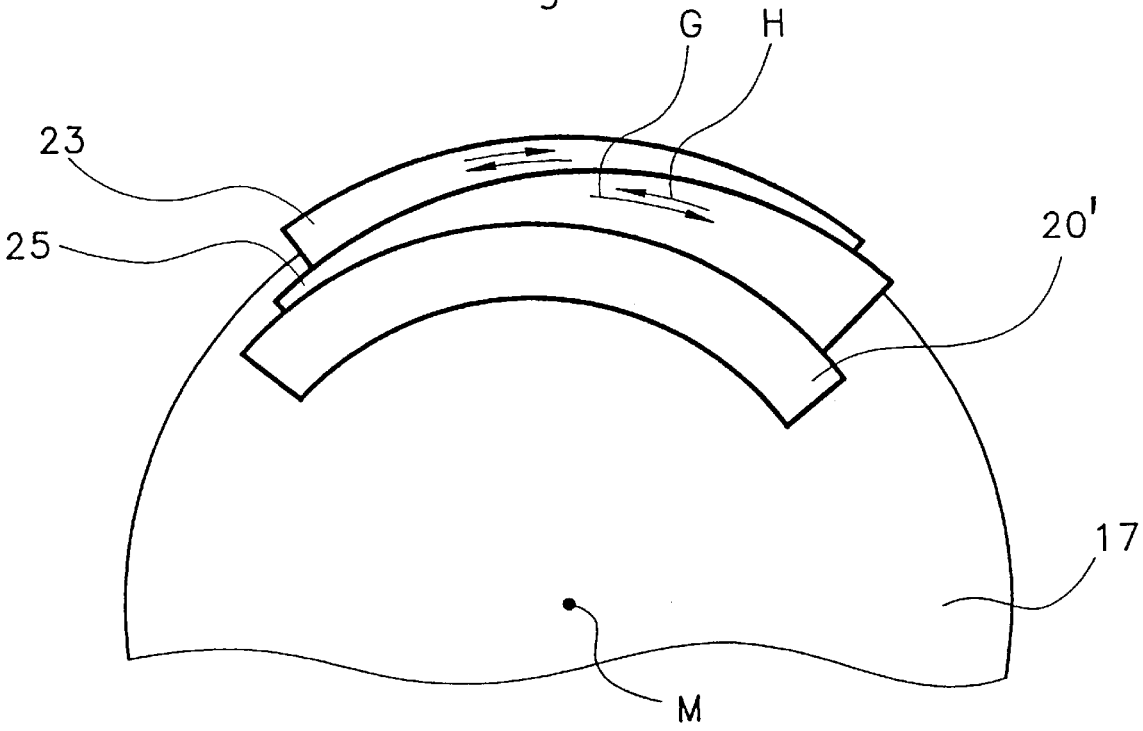
FIG. 5 is a schematic side elevational view similar to FIG. 3 illustrating yet another preferred embodiment of the invention.

Turning to FIG. 5, between the coarse slide backup 201 and the fine slide guide 23 an elongated, wedge-shaped intermediate member 25 is arranged which may be displaced in the direction of the arrows G, H. The intermediate member 25 has a medium slope of 1:50. In this embodiment the slide guide 23 serves for a fine adjustment, the intermediate member 25 serves for compensating for the unlike clothing heights and the coarse slide backup 20' serves for equalizing manufacturing tolerances.

The invention also encompasses a non-illustrated embodiment in which only a single, replaceable coarse slide guide is provided. In such an embodiment, the replacement of slide guides of different radial dimensions is intended.

The bottom face of the groove 18*c* may be concentric or eccentric with respect to the axis M of the cylinder 4. In the former case the carding gap between the flat clothings 14*b* and the cylinder clothing 4*a* is uniform as viewed circumferentially, while in the latter case the carding gap tapers or flares and thus has a wedge shape.

The slide backups 20' and 24 which have a relative large radial dimension c replace the flexible bends of known construction.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder having a cylinder axis and carrying a cylinder clothing on a circumferential surface thereof; said cylinder clothing having clothing points;

(b) a traveling flats assembly cooperating with said main carding cylinder along a circumferential length portion thereof; said traveling flats assembly including (1) a plurality of flat bars each having a flat bar clothing cooperating with said cylinder clothing; said flat bar clothing having clothing points; and (2) drive means for moving said flat bars in unison in an endless path;

(c) a rigid support member fixedly held on a machine frame laterally of said main carding cylinder and having a convex supporting surface; and (d) a slide guide at least indirectly held on said supporting surface of the support member; said slide guide having a convex upper surface supporting said flat bars for sliding motion thereon and an opposite, lower surface; a radial distance between clothing points of the flat bar clothings and the carding cylinder clothing being determined and being changeable by one of a shape and position of said slide guide.

2. The carding machine as defined in claim 1, wherein said radial distance is determined by a radial dimension of said slide guide.

3. The carding machine as defined in claim 1, wherein said upper and lower surfaces of said slide guide extend parallel to one another.

4. The carding machine as defined in claim 1, wherein said slide guide is of a flexible plastic.

5. The carding machine as defined in claim 1, wherein said slide guide is displaceable relative to said support member in a circumferential direction of said carding cylinder.

6. The carding machine as defined in claim 1, wherein said slide guide is replaceable.

7. The carding machine as defined in claim 1, further comprising a side plate forming part of said machine frame; said side plate having a convex surface constituting said convex supporting surface.

8. The carding machine as defined in claim 1, further comprising a side plate forming part of said machine frame and having a convex edge face; further wherein said support component is carried by said side plate and said convex supporting surface of said support component extends parallel to said convex edge face of said side plate.

9. The carding machine as defined in claim 1, further comprising a side plate forming part of said machine frame; further wherein said support component and said side plate form a one-piece, integral component.

10. The carding machine as defined in claim 1, further comprising a side plate forming part of said machine frame; further wherein said support component is cast onto said side plate.

11. The carding machine as defined in claim 1, further comprising a groove provided in said supporting surface of said support component and extending in a circumferential direction of said carding cylinder; said slide guide being received partially in said groove.

12. The carding machine as defined in claim 1, wherein said upper and lower surfaces of said slide guide converge as viewed in a circumferential direction of said carding cylinder, whereby said slide guide has an elongated, wedge-shaped configuration.

13. The carding machine as defined in claim 12, further comprising an arcuate slide backup disposed between said support member and said slide guide and extending in a circumferential direction of said carding cylinder.

14. The carding machine as defined in claim 13, wherein said slide backup has parallel-extending opposite upper and lower surfaces.

15. The carding machine as defined in claim 13, wherein said upper and lower surfaces of said slide backup converge as viewed in a circumferential direction of said carding cylinder, whereby said slide backup has an elongated, wedge-shaped configuration.

16. The carding machine as defined in claim 13, wherein said slide guide and said slide backup have respective wedge slopes; further wherein the wedge slope of said slide guide is less than the wedge slope of said slide backup, whereby a circumferential shifting of said slide backup causes a coarse radial adjustment of said distance and a circumferential shifting of said slide guide causes a fine radial adjustment of said distance.

17. The carding machine as defined in claim 13, wherein said slide guide is circumferentially shiftable relative to said slide backup and said support member.

18. The carding machine as defined in claim 17, wherein said slide backup is circumferentially shiftable relative to said slide guide and said support member.

19. The carding machine as defined in claim 17, further comprising an intermediate member disposed between said slide guide and said slide backup; said intermediate member having upper and lower surfaces converging as viewed in a circumferential direction of said carding cylinder, whereby said intermediate member has an elongated, wedge-shaped configuration.

20. The carding machine as defined in claim 19, wherein said slide guide and said intermediate member have respective wedge slopes; further wherein the wedge slope of said slide guide is less than the wedge slope of said intermediate member, whereby a circumferential shifting of said intermediate member causes a coarse radial adjustment of said distance and a circumferential shifting of said slide guide causes a fine radial adjustment of said distance.

* * * * *